US007654324B2

(12) United States Patent
Chase et al.

(10) Patent No.: US 7,654,324 B2
(45) Date of Patent: Feb. 2, 2010

(54) REVERSE-CIRCULATION CEMENTING OF SURFACE CASING

(75) Inventors: Stephen Chase, Calgary (CA); Gary Maier, Calgary (CA)

(73) Assignee: Halliburton Energy Services, Inc., Duncan, OK (US)

( * ) Notice: Subject to any disclaimer, the term of this patent is extended or adjusted under 35 U.S.C. 154(b) by 259 days.

(21) Appl. No.: 11/778,261

(22) Filed: Jul. 16, 2007

(65) Prior Publication Data

US 2009/0020285 A1 Jan. 22, 2009

(51) Int. Cl.
*E21B 33/14* (2006.01)
*E21B 33/16* (2006.01)

(52) U.S. Cl. ..... 166/287; 166/70; 166/177.4; 166/285; 166/291

(58) Field of Classification Search ..... 166/70
See application file for complete search history.

(56) References Cited

U.S. PATENT DOCUMENTS

| | | | | |
|---|---|---|---|---|
| 2,223,509 | A | | 12/1940 | Brauer |
| 2,230,589 | A | | 2/1941 | Driscoll |
| 2,407,010 | A | | 9/1946 | Hudson |
| 2,472,466 | A | | 6/1949 | Counts et al. |
| 2,647,727 | A | | 8/1953 | Edwards |
| 2,675,082 | A | | 4/1954 | Hall |
| 2,776,013 | A | * | 1/1957 | Tausch ..... 166/150 |
| 2,849,213 | A | | 8/1958 | Failing |
| 2,919,709 | A | | 1/1960 | Schwegman |
| 3,051,246 | A | | 8/1962 | Clark, Jr. et al. |
| 3,193,010 | A | | 7/1965 | Bielstein |
| 3,277,962 | A | | 10/1966 | Flickinger et al. |
| 3,570,596 | A | | 3/1971 | Young |
| 3,948,322 | A | | 4/1976 | Baker |
| 3,948,588 | A | | 4/1976 | Curington et al. |
| 3,951,208 | A | | 4/1976 | Delano |
| 4,105,069 | A | | 8/1978 | Baker |
| 4,271,916 | A | | 6/1981 | Williams |

(Continued)

FOREIGN PATENT DOCUMENTS

EP 0 419 281 A2 3/1991

(Continued)

OTHER PUBLICATIONS

Griffith, et al., "Reverse Circulation of Cement on Primary Jobs Increases Cement Column Height Across Weak Formations," Society of Petroleum Engineers, SPE 25440, 315-319, Mar. 22-23, 1993.

(Continued)

*Primary Examiner*—George Suchfield
(74) *Attorney, Agent, or Firm*—John W. Wustenberg; Baker Botts, LLP

(57) ABSTRACT

An apparatus for reverse circulation cementing of surface casing in subterranean formations and associated methods are provided. One example of a method may involve a method of reverse circulation cementing a surface casing in a well bore with a conductor casing positioned therein comprising: providing a tool comprising at least one isolation device coupled to the surface casing; positioning the isolation device in the well bore to isolate an annulus between the surface casing and the conductor casing; flowing cement through a port in the conductor casing in a reverse circulation direction; and allowing the cement to set therein.

12 Claims, 4 Drawing Sheets

U.S. PATENT DOCUMENTS 4,300,633 A 11/1981 Stewart
4,304,298 A 12/1981 Sutton
4,340,427 A 7/1982 Sutton
4,367,093 A 1/1983 Burkhalter et al.
RE31,190 E 3/1983 Detroit et al.
4,450,010 A 5/1984 Burkhalter et al.
4,457,379 A 7/1984 McStravick
4,469,174 A 9/1984 Freeman
4,519,452 A 5/1985 Tsao et al.
4,531,583 A 7/1985 Revett
4,548,271 A 10/1985 Keller
4,555,269 A 11/1985 Rao et al.
4,565,578 A 1/1986 Sutton et al.
4,671,356 A 6/1987 Barker et al.
4,676,832 A 6/1987 Childs et al.
4,729,432 A 3/1988 Helms
4,791,988 A 12/1988 Trevillion
4,961,465 A 10/1990 Brandell
5,024,273 A 6/1991 Coone et al.
5,117,910 A 6/1992 Brandell et al.
5,125,455 A 6/1992 Harris et al.
5,133,409 A 7/1992 Bour et al.
5,147,565 A 9/1992 Bour et al.
5,188,176 A 2/1993 Carpenter
5,213,161 A 5/1993 King et al.
5,273,112 A 12/1993 Schultz
5,297,634 A 3/1994 Loughlin
5,318,118 A 6/1994 Duell
5,323,858 A 6/1994 Jones et al.
5,361,842 A 11/1994 Hale et al.
5,484,019 A 1/1996 Griffith
5,494,107 A 2/1996 Bode
5,507,345 A 4/1996 Wehunt, Jr. et al.
5,559,086 A 9/1996 Dewprashad et al.
5,571,281 A 11/1996 Allen
5,577,865 A 11/1996 Manrique et al.
5,641,021 A 6/1997 Murray et al.
5,647,434 A 7/1997 Sullaway et al.
5,671,809 A 9/1997 McKinzie
5,718,292 A 2/1998 Heathman et al.
5,738,171 A 4/1998 Szarka
5,743,335 A * 4/1998 Bussear ..... 166/285
5,749,418 A 5/1998 Mehta et al.
5,762,139 A 6/1998 Sullaway et al.
5,803,168 A 9/1998 Lormand et al.
5,829,526 A 11/1998 Rogers et al.
5,875,844 A 3/1999 Chatterji et al.
5,890,538 A 4/1999 Beirute et al.
5,897,699 A 4/1999 Chatterji et al.
5,900,053 A 5/1999 Brothers et al.
5,913,364 A 6/1999 Sweatman
5,968,255 A 10/1999 Mehta et al.
5,972,103 A 10/1999 Mehta et al.
6,060,434 A 5/2000 Sweatman et al.
6,063,738 A 5/2000 Chatterji et al.
6,098,710 A 8/2000 Rhein-Knudsen et al.
6,138,759 A 10/2000 Chatterji et al.
6,143,069 A 11/2000 Brothers et al.
6,167,967 B1 1/2001 Sweatman
6,196,311 B1 3/2001 Treece et al.
6,204,214 B1 3/2001 Singh et al.
6,244,342 B1 6/2001 Sullaway et al.
6,258,757 B1 7/2001 Sweatman et al.
6,311,775 B1 11/2001 Allamon et al.
6,318,472 B1 11/2001 Rogers et al.
6,367,550 B1 4/2002 Chatterji et al.
6,431,282 B1 8/2002 Bosma et al.
6,454,001 B1 9/2002 Thompson et al.
6,457,524 B1 10/2002 Roddy
6,467,546 B2 10/2002 Allamon et al.
6,481,494 B1 11/2002 Dusterhoft et al.
6,484,804 B2 11/2002 Allamon et al.
6,488,088 B1 12/2002 Kohli et al.
6,488,089 B1 12/2002 Bour et al.
6,488,763 B2 12/2002 Brothers et al.
6,540,022 B2 4/2003 Dusterhoft et al.
6,622,798 B1 9/2003 Rogers et al.
6,666,266 B2 12/2003 Starr et al.
6,679,336 B2 1/2004 Musselwhite et al.
6,715,553 B2 4/2004 Reddy et al.
6,722,434 B2 4/2004 Reddy et al.
6,725,935 B2 4/2004 Szarka et al.
6,732,797 B1 5/2004 Watters
6,758,281 B2 7/2004 Sullaway et al.
6,802,374 B2 10/2004 Edgar et al.
6,808,024 B2 10/2004 Schwendemann et al.
6,810,958 B2 11/2004 Szarka et al.
7,013,971 B2 * 3/2006 Griffith et al. ..... 166/250.14
7,108,080 B2 * 9/2006 Tessari et al. ..... 175/21
7,337,840 B2 * 3/2008 Penno ..... 166/278
2002/0148614 A1 10/2002 Szarka
2003/0000704 A1 1/2003 Reynolds
2003/0029611 A1 2/2003 Owens
2003/0072208 A1 4/2003 Rondeau et al.
2003/0192695 A1 10/2003 Dillenbeck et al.
2004/0079553 A1 4/2004 Livingstone
2004/0084182 A1 5/2004 Edgar et al.
2004/0099413 A1 5/2004 Arceneaux
2004/0104050 A1 6/2004 Järvelä et al.
2004/0104052 A1 6/2004 Livingstone
2004/0177962 A1 9/2004 Bour
2004/0231846 A1 11/2004 Griffith et al.
2004/0256157 A1 * 12/2004 Tessari et al. ..... 175/57
2005/0061546 A1 3/2005 Hannegan
2006/0016599 A1 1/2006 Badalamenti et al.
2006/0016600 A1 1/2006 Badalamenti et al.
2006/0042798 A1 3/2006 Badalamenti et al.
2006/0076133 A1 * 4/2006 Penno ..... 166/278
2006/0086499 A1 4/2006 Badalamenti et al.
2006/0086502 A1 4/2006 Reddy et al.
2006/0086503 A1 4/2006 Reddy et al.
2006/0131018 A1 6/2006 Rogers et al.

FOREIGN PATENT DOCUMENTS

GB 2193741 2/1988
GB 2 327 442 A 1/1999
GB 2348828 A 10/2000
RU 1774986 11/1992
RU 1778274 11/1992
RU 1542143 C 12/1994
RU 2067158 9/1996
RU 2086752 C1 8/1997
SU 571584 9/1977
SU 1420139 A1 8/1988
SU 1534183 1/1990
SU 1716096 A1 2/1992
SU 1723309 A1 3/1992
SU 1758211 A1 8/1992
WO WO 2004/104366 12/2004
WO WO 2005/083229 A1 9/2005
WO WO 2006/008490 A1 1/2006
WO WO 2006/064184 A1 6/2006

OTHER PUBLICATIONS

Filippov, et al., "Expandable Tubular Solutions," Society of Petroleum Engineers, SPE 56500, Oct. 3-6, 1999.

Daigle, et al., "Expandable Tubulars: Field Examples of Application in Well Construction and Remediation," Society of Petroleum Engineers, SPE 62958, Oct. 1-4, 2000.

Fryer, "Evaluation of the Effects of Multiples in Seismic Data From the Gulf Using Vertical Seismic Profiles," SPE 25540, 1993.

Carpenter, et al., "Remediating Sustained Casing Pressure by Forming a Downhole Annular Seal With Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication From a Related Counter Part Application, Oct. 12, 2005.
Foreign Communication From a Related Counter Part Application, Sep. 30, 2005.
Foreign Communication From a Related Counter Part Application, Dec. 7, 2005.
Halliburton Brochure Entitled "Bentonite (Halliburton Gel) Viscosifier", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing FlexPlug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the StrataLock Stabilization System", 1998.
R. Marquaire et al., "Primary Cementing by Reverse Circulation Solves Critical Problem in the North Hassi-Messaoud Field, Algeria", SPE 1111, Feb. 1966.
Halliburton Brochure Entitled "Perlite Cement Additive", 1999.
Halliburton Brochure Entitled "The PermSeal System Versatile, Cost-Effective Sealants for Conformance Applications", 2002.
Halliburton Brochure Entitled "Pozmix® A Cement Additive", 1999.
Foreign Communication From a Related Counter Part Application, Dec. 9, 2005.
Foreign Communication From a Related Counter Part Application, Feb. 24, 2005.
Foreign Communication From a Related Counter Part Application, Dec. 27, 2005.
Foreign Communication From a Related Counter Part Application, Feb. 23, 2006.
Foreign Communication From a Related Counter Part Application, Feb. 27, 2007.
Foreign Communication From a Related Counter Part Application, Jan. 8, 2007.
Foreign Communication From a Related Counter Part Application, Jan. 17, 2007.

* cited by examiner

REVERSE-CIRCULATION CEMENTING OF SURFACE CASING

BACKGROUND

The present disclosure generally relates to subterranean cementing operations. More particularly, the present disclosure relates to an apparatus for reverse circulation cementing of surface casing in subterranean formations and associated methods of use.

Cementing of a casing string is often accomplished by pumping a cement slurry down the inside of a tubing or a casing, and then back up the annular space around the casing. In this way, a cement slurry may be introduced into the annular space of the casing (e.g. the annular space between the casing to be cemented and the open hole or outer casing to which the casing is to be cemented). Such methods often are referred to as conventional circulation methods.

Though conventional circulation methods are the methods most commonly used for pumping cement compositions into well bores, these methods may be problematic in certain circumstances. For instance, a well bore may comprise one or more weak formations therein that may be unable to withstand the pressure commonly associated with conventional circulation cementing operations. The formation may breakdown under the hydrostatic pressure applied by the cement, thereby causing the cement to be lost into the subterranean formation. This may cause the undesirable loss of large amounts of cement into the subterranean formation. This problem may be referred to as "lost circulation" and the sections of the formation into which the fluid may be lost may be referred to as "lost circulation zones." The loss of cement into the formation is undesirable, among other things, because of the expense associated with the cement lost into the formation. Likewise, high delivery pressures can cause the undesirable effect of inadvertently "floating" the casing string. That is, exposing the bottom hole of the well bore to high delivery pressures can, in some cases, cause the casing string to "float" upward. Moreover, the equivalent circulating density of the cement may be high, which may lead to problems, especially in formations with known weak or lost circulation zones.

Another method of cementing casing, sometimes referred to as reverse circulation cementing, involves introducing the cement slurry directly from the surface into the annular space rather than introducing the cement slurry down the casing string itself. In particular, reverse circulation cementing avoids the higher pressures necessary to lift the cement slurry up the annulus. Other disadvantages of having to pump the cement slurry all the way down the casing string and then up the annulus are that it requires a much longer duration of time than reverse circulation cementing. This increased job time is disadvantageous because of the additional costs associated with a longer duration cementing job. Moreover, the additional time required often necessitates a longer set delay time, which may require additional set retarders or other chemicals to be added to the cement slurry.

Typically, when cementing strings of casing, such as production casing or intermediate casing, a means of isolating the annulus is required to divert flowback of the cement up and out to the flowline. Such methods often require the use of conventional pack-off means such as a diverter or blowout preventers. Moreover, a volume based method is typically used, wherein the anticipated volume of cement needed to cement the casing string is calculated. The calculated volume may be doubled or even tripled in some instances and that amount of cement may be pumped into the formation to cement the casing string. This method causes excessive cement waste and costs affiliated with the volume of cement used.

Reverse circulation cementing of surface casing may pose certain obstacles as well. In the presence of only a conductor casing or in an open-hole, a diverter may need to be installed on a conductor casing prior to reverse circulation cementing a surface casing to isolate the annulus between a conductor casing and a surface casing. These structures are often complex and expensive, thus increasing the cost of completing the well. Moreover, in certain regions of the world, the number of diverters available for use in cementing operations may be unable to accommodate the demand for them. Thus, there is a need for a cost-effective and readily available means to isolate the annulus between a conductor casing and a surface casing for reverse circulation cementing of a surface casing.

SUMMARY

The present disclosure generally relates to subterranean cementing operations. More particularly, the present disclosure relates to an apparatus for reverse circulation cementing of surface casing in a subterranean formations and associated methods of use.

In one embodiment, the present disclosure provides a system for reverse circulation cementing of a surface casing string comprising a conductor casing, a surface casing string positioned within the conductor casing, and an isolation device coupled to a surface casing string.

In another embodiment, the present disclosure provides a method of reverse circulation cementing a surface casing in a well bore with a conductor casing positioned therein comprising: providing a tool comprising at least one isolation device coupled to the surface casing; positioning the isolation device in the well bore to isolate an annulus between the surface casing and the conductor casing; flowing cement through a port in the conductor casing in a reverse circulation direction; and allowing the cement to set therein.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

The present disclosure generally relates to subterranean cementing operations. More particularly, the present disclosure relates to an apparatus for reverse circulation cementing of surface casing in subterranean formations and associated methods of use.

The apparatus and methods of the present disclosure may allow for reverse circulation cementing of a surface casing. In particular, the methods and apparatus of the present disclosure may allow for improved isolation of the annular space between the surface casing to be cemented and the outer casing and/or open hole to which the casing is to be cemented. In certain embodiments, this outer casing may be a conductor casing. The methods and apparatus of the present disclosure provide an efficient means for reverse circulation cementing of surface casing with a conductor casing in place, but in the absence of a diverter or blow out preventer. As used herein, "conductor casing" refers to a pipe installed in a well to provide a conductor for fluid through surface formations and prevent sloughing of the ground and formation. By eliminating the need for a diverter, the apparatus of the present disclosure may provide, a cost-effective alternative for reverse cementing surface casing in the presence of a conductor casing. Moreover, reverse circulation cementing of a surface casing using the apparatus and methods of the present disclosure may provide a means by which lost circulation may be minimized. In addition, the methods and apparatus of the present disclosure may provide savings in rig time and associated costs in labor and cement.

To facilitate a better understanding of the present invention, the following examples of certain aspects of some embodiments are given. In no way should the following examples be read to limit, or define, the entire scope of the invention.

Figure 1:
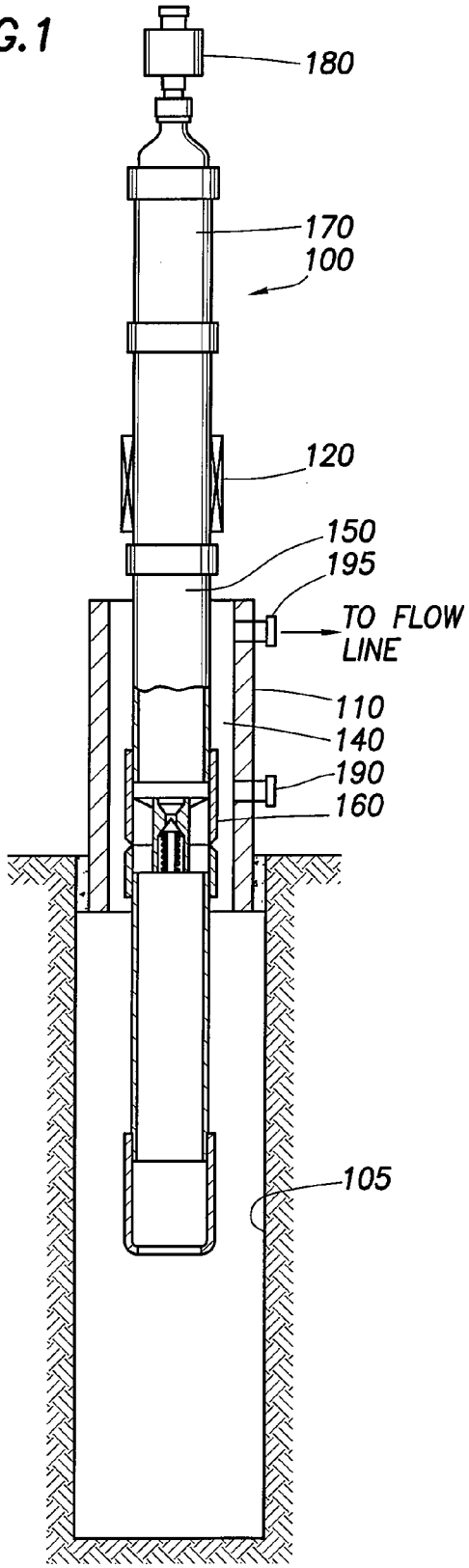
FIG. 1 illustrates a cross-sectional view of a reverse cementing apparatus, according to one embodiment of the present disclosure.

Referring now to FIG. 1, a reverse cementing tool is illustrated, according to one embodiment of the present disclosure. Initially, reverse cementing tool 100 is positioned above conductor casing 110 that is positioned in well bore 105. Conductor casing 110, though illustrated as cemented into well bore 105, may be positioned in wellbore 105 using any means known in the art. Reverse cementing tool 100 generally comprises an isolation device 120 coupled to a surface casing string 150. Isolation device 120 may be any device that provides at least partial fluidic isolation of annulus 140. In certain embodiments, isolation device 120 may comprise a rubber cup, a cement basket, or a permanent or retrievable packer. In certain other embodiments, isolation device 120 may comprise elastomeric materials, thermoplastic materials, inflatable packer, steel compsites, resins, and expandable packers, or combinations thereof. Isolation device 120 may be coupled to surface casing string 150 by any means known in the art. In certain embodiments, more than one isolation device may be coupled to surface casing string 150.

In certain other embodiments, reverse cementing tool 100 may further comprise reverse cementing collar 160. Surface casing string 150 may be coupled to reverse cementing collar 160. U.S. Pat. No. 6,244,342 issued to Sullaway et al. on Jun. 12, 2001, which is herein incorporated by reference, discloses reverse cementing collars suitable for use in conjunction with the methods and apparatus of the present disclosure.

Reverse cementing tool 100 may further comprise handling sub 170 cement head 180, and isolation device 120. Handling sub 170 may be coupled to surface casing string 150, to provide a means by which reverse cementing tool 100 can be positioned in well bore 105. Cement head 180 may be coupled to handling sub 170. Cement head 180 may provide a means for flow through reverse cementing tool 100 in a conventional direction. Both cement head 180 and handling sub 170 may be coupled to surface casing string 150 using any means known to one of ordinary skill in the art. In the embodiment illustrated in FIG. 1, circulation of fluid may be established down surface casing string 150 and up annulus 140 in a conventional direction. Fluids suitable for use in this embodiment includes any fluid that may be used in cementing and drilling operations. Examples of suitable fluids include, but are not limited to, circulation fluids, drilling fluids, displacement fluids, lost circulation pills, and spacer fluids. Conductor casing 110 may comprise at least two ports. Port 190 of conductor casing 110 may be used to collect fluid returns in this embodiment. Port 195 of conductor casing 110 serves as a connection to the flowline (not shown) and may also be used to collect fluid returns, in certain embodiments.

Figure 2:
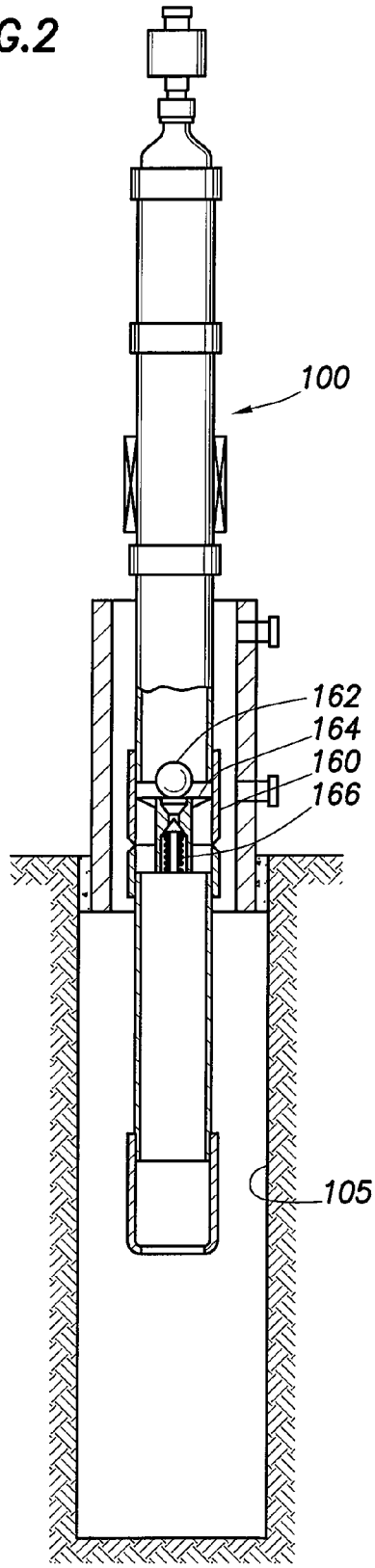
FIG. 2 illustrates a cross-sectional view of a reverse cementing apparatus, following dropping of a ball into the surface casing, according to one embodiment of the present disclosure.

Referring now to FIG. 2, once conventional circulation has been established, releasing ball 162 is dropped down reverse cementing tool 100 and engages seat 164 in reverse cementing collar 160. Pressure is applied to releasing ball 162 to disconnect check valve 166 from the reverse cementing collar 160.

Figure 3:
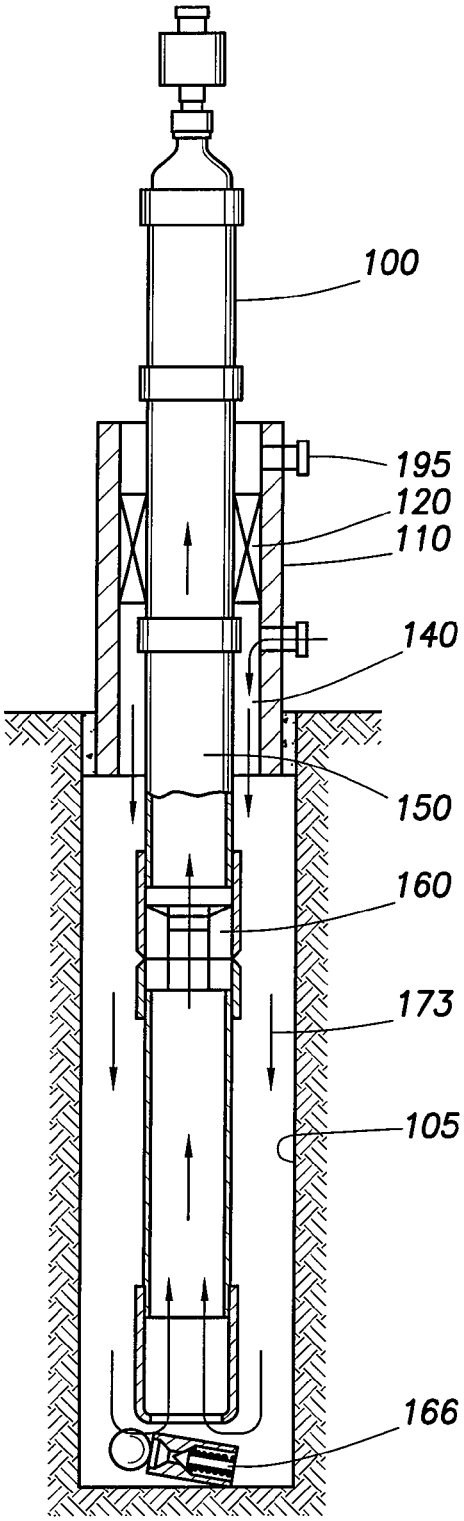
FIG. 3 illustrates a cross-sectional view of a reverse cementing apparatus, with surface casing lowered into place, following pumping of the check valve out of the string, according to one embodiment of the present disclosure.

Referring now to FIG. 3, check valve 166 has been released from reverse cementing collar 160, and reverse cementing tool 100 is ready for reverse circulation of fluid. Reverse cementing tool 100 is lowered into well bore 105 so that isolation device 120 contacts conductor casing 110 and forms a seal to isolate annulus 140 and port 195 to the flowline. Reverse cementing tool 100 may be lowered into well bore 105 using any means known in the art. Isolation device 120 may be positioned between port 195 to the flowline and port 190, thereby providing a seal between conductor casing 110 and the surface casing string 150. The seal allows for the effective isolation of annulus 140 thereby allowing surface casing string 150 to be cemented using a reverse cementing operation and preventing flowback of the cement out of the annulus 140. The size of isolation device 120 may be modified to accommodate a particular size of conductor casing 110.

Following placement of reverse cementing tool 100, reverse circulation of fluids may be established. Fluid 173 may be flowed into port 190 and down annulus 140 and up surface casing string 150. Fluids suitable for use in these embodiments include any fluid that may be used in cementing and drilling operations. Examples of suitable fluids include, but are not limited to, circulation fluids, drilling fluids, lost circulation pills, displacement fluids, and spacer fluids.

Figure 4:
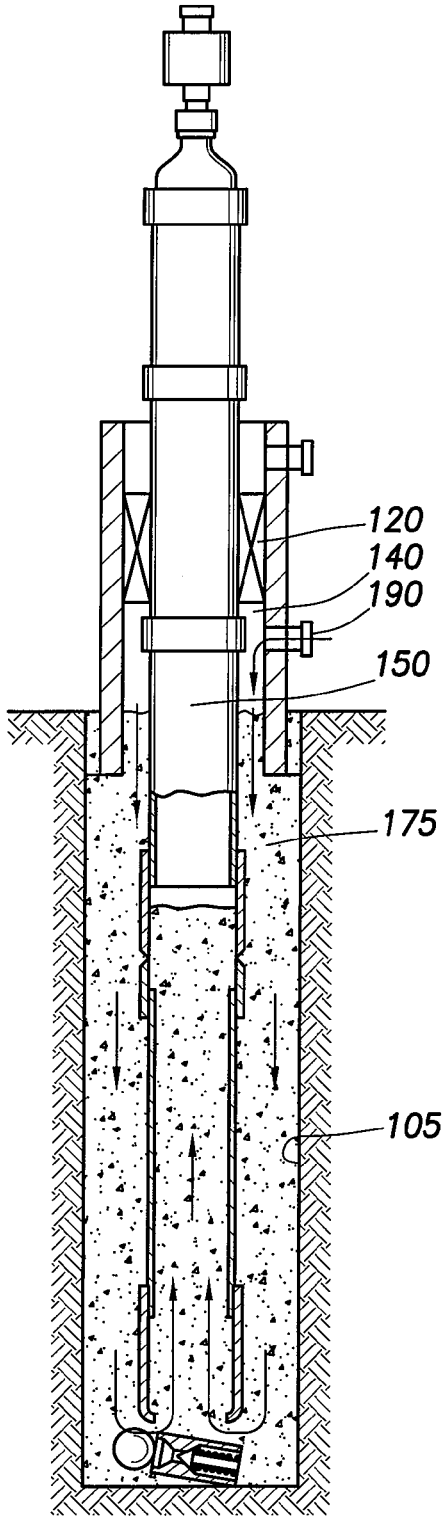
FIG. 4 illustrates pumping/flowing of a cement composition through a port in a conductor casing to cement a surface casing using a reverse circulation method, according to one embodiment of the present disclosure.

Cement slurry 175 may be introduced by pumping or any other means. Referring now to FIG. 4, cement slurry 175 may be pumped through port 190 and down annulus 140 to cement surface casing string 150 into well bore 105. Isolation device 120 provides a means to control the flow of cement slurry 175 and to isolate annulus 140 and port 195. By flowing cement slurry 175 in a reverse circulation direction, the equivalent circulating density of the cement slurry may be minimized. Moreover, damage to the formation and lost circulation may also be minimized.

Placement of cement slurry 175 is achieved due to free-fall of cement slurry 175 from port 190, down annulus 140, and around surface casing string 150. In certain embodiments, port 190 may serve as a means to inspect placement of the falling cement slurry 175. Cement slurry 175 may be any cement suitable for use to cement casing. Additional additives may be added to the cement used in conjunction with the methods and apparatus of the present invention as deemed appropriate by one skilled in the art with the benefit of this disclosure. Examples of such additives include, inter alia, fluid loss control additives, lost circulation materials, defoamers, dispersing agents, set accelerators, salts, formation conditioning agents, weighting agents, set retarders, and the like.

Figure 5:
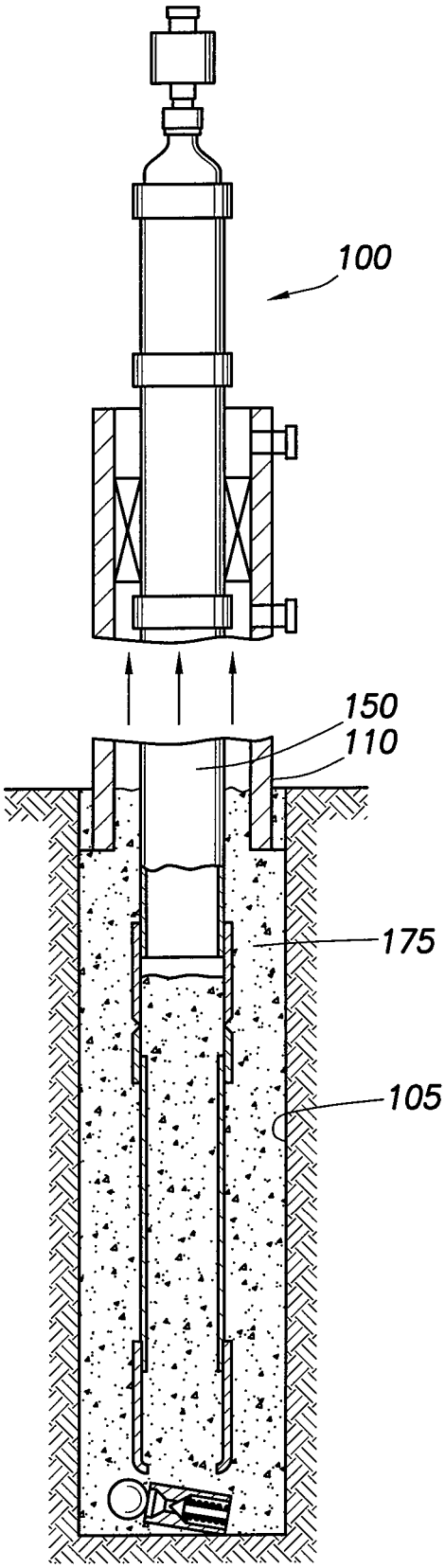
FIG. 5 illustrates a cross-sectional view of a surface casing, during removal of the reverse cementing apparatus, according to one embodiment of the present disclosure.
Figure 6:
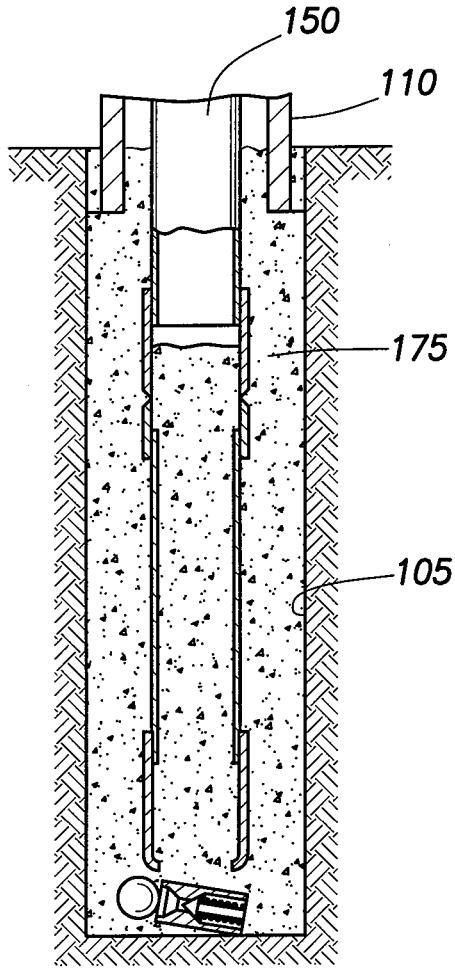
FIG. 6 illustrates a cross-sectional view of a surface casing following removal of the reverse cementing apparatus, according to one embodiment of the present disclosure.

Referring now to FIG. 5, following the reverse circulation cement job and setting of cement slurry 175, reverse cementing tool 100 may be detached from surface casing string 150 by any means known in the art. In the embodiment illustrated, reverse cementing tool 100 is cut from surface casing string 150 and conductor casing 110, leaving a portion of surface casing string 150 and conductor casing 110 cemented into place in well bore 105, as illustrated in FIG. 6. This allows for re-use of reverse cementing tool 100 in other well bore applications. Reverse cementing tool 100 may be removed from well bore 105 using any conventional means for positioning casing known in the art. Following the reverse cementing of surface casing string 150, additional well bore operations may be performed, including, but not limited to, installation of blow out preventers on top of the surface casing string, drilling operations, and placement and cementing of additional strings of casing.

Figure 7:
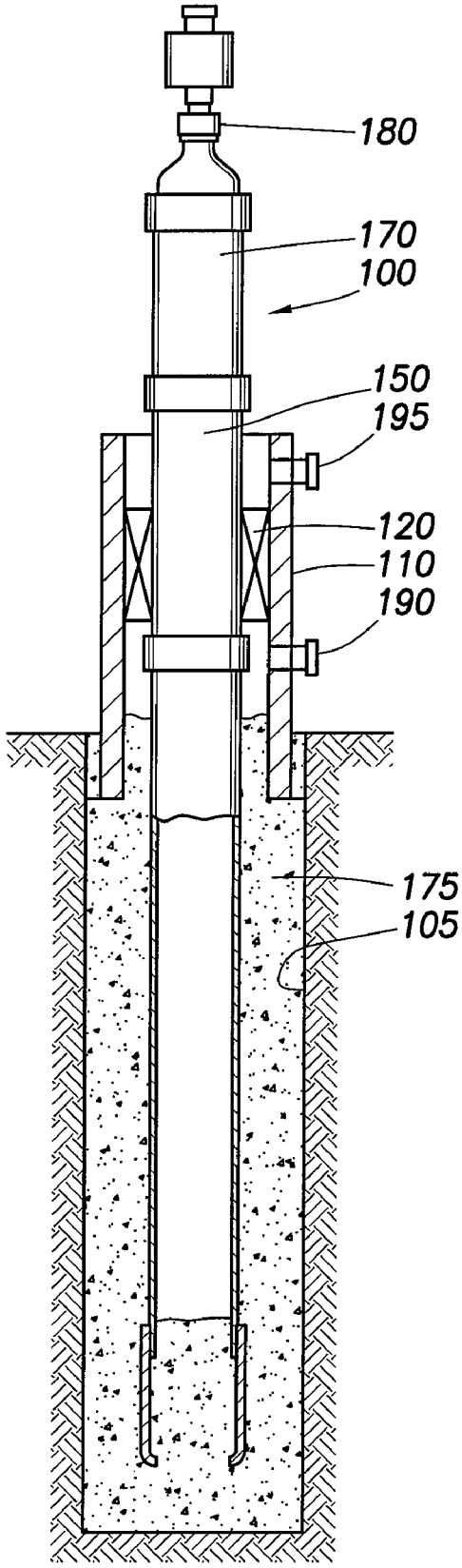
FIG. 7 illustrates a cross-sectional view of an alternative embodiment of the present disclosure that does not utilize a reverse cementing collar.

Referring now to FIG. 7, in certain embodiments, reverse cementing collar may be optionally omitted from surface casing string 150. Surface casing string 150 may be cemented using a reverse circulation method as described in previous embodiments of the present disclosure without the use of a reverse circulation collar.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, and set forth every range encompassed within the broader range of values. Also, the terms in the claims have their plain, ordinary meaning unless otherwise explicitly and clearly defined by the patentee.

What is claimed is:

1. A method of reverse circulation cementing a surface casing in a well bore with a conductor casing positioned therein comprising:

providing a tool comprising at least one isolation device coupled to the surface casing;

positioning the tool in the well bore with the isolation device in the conductor casing to isolate an annulus between the surface casing and the conductor casing;

flowing cement through a port in the conductor casing in a reverse circulation direction; and allowing the cement to set therein.

2. The method of claim 1 further comprising flowing a fluid into the annulus in a reverse circulation direction prior to flowing the cement.

3. The method of claim 2 wherein the fluid is a circulation fluid, a spacer fluid, a displacement fluid, or a drilling fluid.

4. The method of claim 1 further comprising establishing conventional circulation down the tool.

5. The method of claim 1 wherein the flowing of the cement composition in a reverse circulation direction is performed without the use of a conventional diverter or blow out preventer.

6. The method of claim 1 further comprising cementing the conductor casing in the well bore.

7. The method of claim 1, wherein the tool further comprises a reverse circulation cementing collar comprising a check valve.

8. The method of claim 7 further comprising dropping a releasing ball down the tool and pressurizing the ball to release the check valve the from reverse cementing collar.

9. The method of claim 1 wherein the isolation device is a rubber cup, a cement basket, a permanent packer, a retrievable packer, an inflatable packer, or an expandable packer.

10. The method of claim 1 wherein the conductor casing comprises at least two ports, and wherein positioning the tool in the well bore comprises positioning the isolation device between the two ports.

11. The method of claim 10 wherein one of the ports is connected to a flowline.

12. The method of claim 1 further comprising removing the tool from the surface casing.

* * * * *